US010900496B2

(12) United States Patent
Weiss

(10) Patent No.: US 10,900,496 B2
(45) Date of Patent: Jan. 26, 2021

(54) RADIAL COMPRESSOR

(71) Applicant: BMTS Technology GmbH & Co. KG, Stuttgart (DE)

(72) Inventor: Hartmut Weiss, Stuttgart (DE)

(73) Assignee: BMTS TECHNOLOGY GMBH & CO. KG

( * ) Notice: Subject to any disclaimer, the term of this patent is extended or adjusted under 35 U.S.C. 154(b) by 37 days.

(21) Appl. No.: 16/439,692

(22) Filed: Jun. 12, 2019

(65) Prior Publication Data

US 2019/0383306 A1 Dec. 19, 2019

(30) Foreign Application Priority Data

Jun. 14, 2018 (DE) ..... 10 2018 209 558

(51) Int. Cl.
*F04D 17/10* (2006.01)
*F04D 29/053* (2006.01)
*F04D 29/46* (2006.01)

(52) U.S. Cl.
CPC ..... *F04D 29/464* (2013.01); *F04D 17/10* (2013.01); *F04D 29/053* (2013.01); (Continued)

(58) Field of Classification Search
CPC .... F04D 17/10; F04D 29/053; F04D 29/4213; F04D 29/464; F04D 29/681; F05B 2220/40; F05B 2240/60; F05B 2250/50
See application file for complete search history.

(56) References Cited

U.S. PATENT DOCUMENTS

2007/0224032 A1* 9/2007 Gu ..... F04D 29/681 415/58.4
2008/0267765 A1* 10/2008 Chen ..... F04D 29/4213 415/58.4

(Continued)

FOREIGN PATENT DOCUMENTS

DE 36 05 958 A1 9/1987
DE 10 2008 007 027 A1 8/2009

(Continued)

OTHER PUBLICATIONS

English abstract for JP-5223642.

(Continued)

*Primary Examiner* — Igor Kershteyn
(74) *Attorney, Agent, or Firm* — Fishman Stewart PLLC

(57) ABSTRACT

A radial compressor for an exhaust gas turbocharger may include a compressor housing in which a flow channel is arranged, a compressor wheel arranged in the flow channel, a device influencing a characteristic field, and a discharge channel. The flow channel may delimit a flow path of air through the radial compressor. The flow channel may have a suction section via which the compressor wheel sucks in air. The compressor housing may have a circumferential section circumferentially surrounding the compressor wheel in which a spiral channel of the flow channel may be arranged via which air compressed by the compressor wheel flows out. The device may include a cavity fluidically connected to the suction section. The discharge channel may be arranged in the compressor housing feeding, via an inlet mouth point, into the cavity and extending to an outlet mouth point fluidically connecting the cavity to the spiral channel.

20 Claims, 2 Drawing Sheets

(52) U.S. Cl.
CPC ..... *F05B 2220/40* (2013.01); *F05B 2240/60* (2013.01); *F05B 2250/50* (2013.01)

(56) References Cited

U.S. PATENT DOCUMENTS

| | | | | |
|---|---|---|---|---|
| 2009/0013689 | A1* | 1/2009 | Sumser | F01D 9/026 60/605.1 |
| 2011/0255952 | A1* | 10/2011 | Williams | F04D 29/681 415/1 |
| 2015/0063989 | A1* | 3/2015 | Wang | F04D 29/286 415/157 |
| 2015/0192133 | A1* | 7/2015 | An | F04D 25/024 415/203 |
| 2015/0192147 | A1* | 7/2015 | An | F04D 17/10 415/58.4 |
| 2016/0201693 | A1* | 7/2016 | An | F04D 29/444 415/58.4 |

FOREIGN PATENT DOCUMENTS

| | | | |
|---|---|---|---|
| DE | 10 2010 026 176 | A1 | 1/2012 |
| DE | 10 2015 111 462 | B3 | 9/2016 |
| EP | 2 615 308 | A1 | 7/2013 |
| EP | 3 043 045 | A2 | 7/2016 |
| JP | 2004 162578 | A | 6/2004 |
| JP | 5223642 | B2 | 6/2013 |
| JP | 2015-165107 | A | 9/2015 |

OTHER PUBLICATIONS

English abstract for DE-10 2010 026 176.
English abstract for JP-2015-165107.
English abstract for DE-36 05 958.
English abstract for DE-10 2015 111 462.
English abstract for DE-10 2008 007 027.
English abstract for JP-2004 162578.

* cited by examiner

RADIAL COMPRESSOR

CROSS-REFERENCE TO RELATED APPLICATIONS

This application claims priority to German Patent Application No. DE 10 2018 209 558.2, filed on Jun. 14, 2018, the contents of which are hereby incorporated by reference in its entirety.

TECHNICAL FIELD

The present invention relates to a radial compressor for an exhaust gas turbocharger, which comprises a compressor housing in which a compressor wheel is rotatably arranged, and which comprises a device for varying the flow cross-section. The invention further comprises an exhaust gas turbocharger with such a radial compressor.

BACKGROUND

Exhaust gas turbochargers normally have a turbine wheel and a compressor wheel, which are operatively connected by means of a shaft for example. The turbine wheel is driven by exhaust gas from a combustion engine and thus drives the compressor wheel, which compresses air to be fed to the combustion engine. With a radial compressor, also called a centrifugal compressor, the compressor wheel axially sucks in the air to be compressed, and the compressed air is radially accelerated, compressed and exhausted. Normally the compressed air reaches a spiral channel in a compressor housing of the radial compressor and is forwarded via the spiral channel to, in particular, a combustion engine.

Such a radial compressor is known from the JP 2015-165107 A. With this radial compressor a drainage channel is provided, which extends from a suction section of the radial compressor axially joined to the compressor wheel and via which the compressor wheel sucks in air when in operation, to the spiral channel and which describes an L-shaped and thus non-linear path when viewed in cross-section. The drainage channel serves the purpose of guiding condensate generated in the suction section into the spiral channel. In order to achieve this, it is necessary to install the radial compressor and the exhaust gas turbocharger in an oblique manner such that the shaft of the compressor wheel is always inclined to the horizontal. This places restrictions on the possible use of the radial compressor.

It is desirable with radial compressors of this kind, to be able to influence, in particular vary, the characteristic field of the radial compressor, in order to influence or change the compressor output, for example. This is done e.g. with the aid of a device which influences the fluidic flows in the radial compressor, for example the flow cross-section in the suction section of the radial compressor, and/or varies these downstream of the compressor wheel with the aid of at least one adjustable element. Devices of this kind normally comprise a cavity, which is arranged in the compressor housing and which is fluidically connected to the suction section.

It is known, for example, from the DE 10 2010 026 176 B4 to provide such a device with a cone as the adjustable element. The EP 3 043 045 A2 proposes a variable geometry as a device. From the JP 5223642 B2 it is known to provide such a device with a blind, which is arranged in the suction section and can be adjusted.

SUMMARY

The present invention is engaged in the task of proposing improved or at least other embodiments for a radial compressor of the kind mentioned above as well as for an exhaust gas turbocharger with such a radial compressor, which in particular are characterised by a longer service life and/or by an improved operation.

According to the invention this task is solved by the subjects of the independent claim(s). Advantageous embodiments are the subject of the dependent claim(s).

The present invention is based on the general idea to fluidically connect a cavity fluidically connected with a suction section of a radial compressor, which in operation influences the characteristic field of the radial compressor, to the spiral channel of the radial compressor with the aid of a discharge channel. This involves making use of the knowledge that liquid, in particular condensate, accumulates in these cavities during operation of the radial compressor, which through corrosion for example can lead to damage of the radial compressor, in particular the device and/or the compressor housing. Moreover, the liquid, in particular the condensate, can freeze at low temperatures and lead to further damage and adverse effects on the radial compressor and/or the device. This circumstance is reinforced if the air sucked in during operation by a compressor wheel of the radial compressor and which in the following is called suction air, is mixed with part of the exhaust gas of an associated combustion engine in the form of an exhaust gas recirculation. Apart from moisture which may be present in the form of condensate the suction air then also contains foreign particles which accumulate in the cavity and may lead to damage. The discharge channel avoids this damage or reduces the same due to guiding the liquid, in particular the condensate and/or the foreign particles out of the cavity. As a result operation of the radial compressor, in particular of the device, is improved and/or the service life of the radial compressor is prolonged.

Accordingly the radial compressor, in line with the inventive idea, comprises a compressor housing in which a flow channel is arranged, in particular formed. The flow channel delimits a flow path of the air sucked in and compressed during operation. The compressor wheel is rotatably arranged in the compressor housing, in particular in the flow channel. The compressor wheel is non-rotatably mounted on a shaft, which in turn is rotatably arranged in the compressor housing. The flow channel comprises a suction section via which the compressor wheel sucks in air or suction air during operation. In circumferential direction the compressor wheel is surrounded by a circumferential portion of the compressor housing, in which the spiral channel extending in circumferential direction is arranged, in particular formed. Air compressed in operation by the compressor wheel reaches the spiral channel and from there can be passed on to in particular a combustion engine. The device for influencing the characteristic field of the radial compressor comprises a cavity which is fluidically connected or connectable to the suction section and in particular surrounds the same. According to the invention a discharge channel is arranged, in particular formed, in the compressor housing, which leads via an inlet mouth point into the cavity, extends as far an outlet mouth point and fluidically connects the cavity to the spiral channel.

The suction section is arranged upstream of the compressor wheel and in particular axially adjoins the compressor wheel at the face. Advantageously the suction section extends axially, at least in sections.

The axial direction, in the present context, is defined by the axis of rotation of the shaft, on which the compressor wheel is mounted, in such a manner that the axial direction extends parallel to the axis of rotation. The radial direction extends at right angles to the axial direction/the axis of rotation. The circumferential direction extends around the axis of rotation.

The device for influencing the characteristic field is predominantly understood to mean any device which comprises the cavity and which influences the characteristic field via changes in the flow cross-section and/or fluidic connections.

In particular, the device is a device for stabilising the characteristic field, in particular the characteristic curves, of the radial compressor. In this case the device, via the cavity and the discharge channel, establishes a fluidic connection between the suction section and the spiral channel.

Equally, the device may comprise an adjustable element, which by means of adjustment leads to a change in the flow cross-section in the suction section or downstream of the compressor wheel such that the characteristic field of the radial compressor can be changed. These devices may for example, comprise a blind, a cone or the like. Moreover these devices may comprise a variably adjustable geometry. The adjustable element is advantageously received in the cavity so that the cavity is in fact a receiving chamber.

With this arrangement the element, when being adjusted, can lead to impacting the flow in the suction section of the compressor or downstream of the compressor wheel. The fluidic connection between cavity and suction section of the compressor or downstream of the compressor exists in particular because of the necessary clearances (literally: plays) independent of the position of the element. The element is capable, in order to impact the flow, of adjusting other components of the device, for example at least a blind, at least a cone or the like, or it may be configured as a blend, a cone or the like.

The liquid accumulating in the cavity may, apart from the condensate generated, also comprise other constituents such as oil or fuel residues or the like. In the following, for simplicity's sake, the term condensate stands for liquid.

As advantageous are considered embodiments, in which the discharge channel connects the cavity via a diffuser in the flow channel of the radial compressor to the spiral channel, the spiral channel being the channel through which the flow path leads and which extends, in particular radially, between the compressor wheel and the spiral channel. Thus the cavity/the condensate in it and foreign particles can be sucked out of the cavity when the radial compressor is operating, so that the condensate and/or the foreign particles are removed from the cavity in an enhanced manner.

Preferably the discharge channel is laid out in such a way that liquid, in particular condensate, accumulating in the cavity is discharged into the spiral channel or diffuser even when the compressor wheel is not operating, or in other words, when there is no pressure difference between the suction area and the spiral channel. Normally this is achieved by a respective gradient/overall gradient of the discharge channel. In particular there is as a result no need for arranging the shaft at an incline to the horizontal.

It is advantageous if the outlet mouth point is spaced apart from the inlet mouth point in the radial or axial direction. It is preferred if the outlet mouth point relative to the inlet mouth point is arranged axially further away from the suction section and radially deeper, i.e. in direction of the spiral channel. To this end the discharge channel may extend in axial and/or radial direction, at least in sections, and is radially inclined. This allows a simple and reliable discharge of condensate and/or foreign particles out of the cavity into the spiral channel/diffusor.

With advantageous embodiments the discharge channel comprises a constant gradient from the inlet mouth point to the outlet mouth point, such that due to the gradient condensate and/or foreign particles flow through/get into the discharge channel. The constant gradient reduces the danger of condensate and/or foreign particles being carried away even without a pressure difference and/or not being caught in the discharge channel.

It is advantageous if the inlet mouth point is arranged at an end of the receiving chamber facing away from the shaft. In particular the inlet mouth point is arranged at a lower end of the receiving chamber, which for a horizontal layout of the shaft is arranged lowest relative to the vertical. As a result all the condensate and/or foreign particles accumulating in the receiving chamber are carried away through the discharge channel.

The outlet mouth point is preferably arranged on the side of inlet mouth point facing away from the shaft and axially distanced from the inlet mouth point. In particular, this device that the outlet mouth point is arranged below the inlet mouth point and also axially distanced therefrom. The condensate in the discharge channel can therefore flow more easily from the inlet mouth point to the outlet mouth point.

One could imagine embodiments in which the outlet mouth point is arranged on the spiral channel so that the discharge channel extends as far as the spiral channel and directly feeds into it.

It is feasible that the outlet mouth point is arranged on the diffuser so that the discharge channel extends as far as the diffuser.

Advantageously the receiving chamber comprises a catchment trough on the side facing away from the shaft, in particular at the end facing radially away from the receiving chamber, which advantageously is the lower end of the receiving chamber in the installed position. The catchment trough is where during operation condensate and foreign particles are caught. The inlet mouth point is arranged in/on the catchment trough such that the discharge channel feeds into the catchment trough via the inlet mouth point. This leads to an improved discharge of condensate and/or foreign particles out of the receiving chamber.

Embodiments have proven to be advantageous, in which the catchment trough tapers radially towards the mouth point and is thus configured or shaped like a funnel. As a result condensate and/or foreign particles can also accumulate in the catchment trough if the radial compressor/the associated exhaust gas turbocharger comprises an inclined position relative to the horizontal, for example due to an oblique arrangement, as can occur when an associated vehicle is driving up a slope or driving down a slope.

The catching of condensate and/or foreign particles in the catchment trough is improved in that the catchment trough additionally extends in circumferential direction.

The discharge channel may in principle be a channel separate from the compressor housing, for example in the manner of a tubular body. Preferably the discharge channel is designed as a bore drilled into the compressor housing. This makes it easy to provide the discharge channel in the radial compressor and/or reduces thermal tensions within the compressor housing.

In principle the discharge channel may comprise a number of sections extending mutually inclined to one another, and called discharge sections hereunder. In particular the discharge channel may comprise a first discharge section, which extends from the inlet mouth point to a second discharge section, which extends as far as the outlet mouth point. In cross-section the discharge sections then extend inclined to one another such that condensate and/or foreign particles accumulating in the receiving chamber reach the outlet mouth point without any inclines of the radial compressor. The discharge sections may then follow one another in particular in a zigzag pattern or snake-like pattern, always extending at an incline towards the shaft.

It is understood that in addition to the radial compressor an exhaust gas turbocharger with such a radial compressor falls within the scope of the invention.

The exhaust gas turbocharger comprises a turbine with a turbine wheel, which in operation is driven by exhaust gas, in particular a combustion engine thereby driving the compressor wheel of the radial compressor, in particular via the shaft.

Further important features and advantages of the invention are revealed in the sub-claims, the drawing and the associated description of the figures with reference to the drawings.

It is understood that the above-mentioned features and features still to be explained can be utilised not only in the respectively specified combination, but also in other combinations or on their own without leaving the scope of the present invention.

BRIEF DESCRIPTION OF THE DRAWINGS

Preferred exemplary embodiments of the invention are depicted in the drawings and will be explained in detail in the description hereunder, wherein identical reference symbols refer to identical or similar or functionally identical components, and wherein schematically

DETAILED DESCRIPTION

Figure 1:
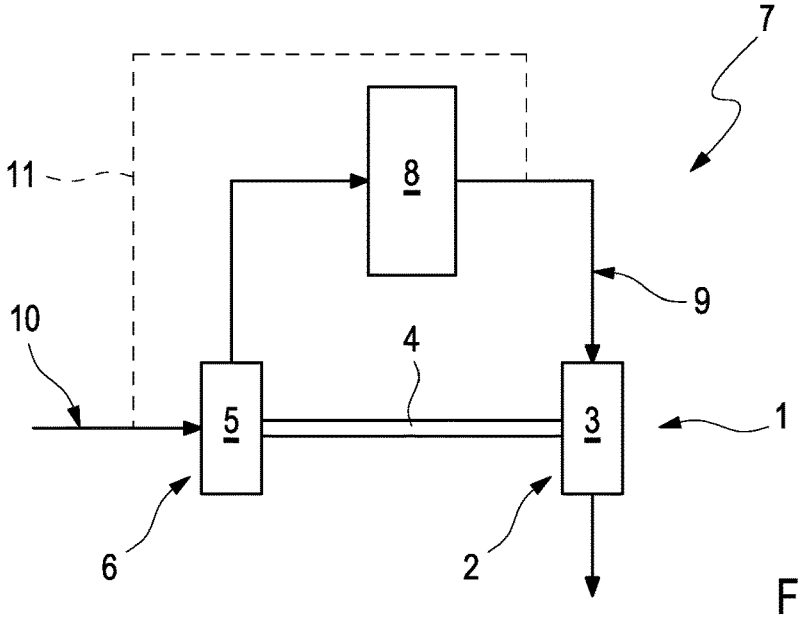
FIG. 1 shows a strongly simplified, circuit-like depiction of a combustion engine system with an exhaust gas turbocharger.

An exhaust gas turbocharger 1 such as depicted in FIG. 1, comprises a turbine 2 with a turbine wheel 3, which is driven by exhaust gas when in operation. In the exemplary embodiment shown the turbine wheel 3 is drivingly connected via a shaft 4 to a compressor wheel 5 of a radial compressor 6. The compressor wheel 5 axially sucks in air, also called suction air in the following, and compresses the same in radial direction. In the example shown the exhaust gas turbocharger 1 is part of a combustion engine system 7, which apart from the exhaust gas turbocharger 1 also comprises a combustion engine 8. The exhaust gas for driving the turbine wheel 3 originates in the combustion engine 8 and is fed to the turbine wheel 3 via an exhaust gas system 9 of the combustion engine system 7. The radial compressor 6/the compressor wheel 5 are, by comparison, installed in a fresh air plant 10 of the combustion engine system 7, the fresh air plant 10 serving to supply air to the combustion engine. Part of the exhaust air being generated in the combustion engine 8 can be fed via an exhaust gas recirculation line 11 to the fresh air plant 10, in particular upstream of the radial compressor 6. In the example shown, the exhaust gas is taken off the exhaust gas system 9 upstream of the turbine 2, but this can also be done downstream of the turbine 2.

Figure 2:
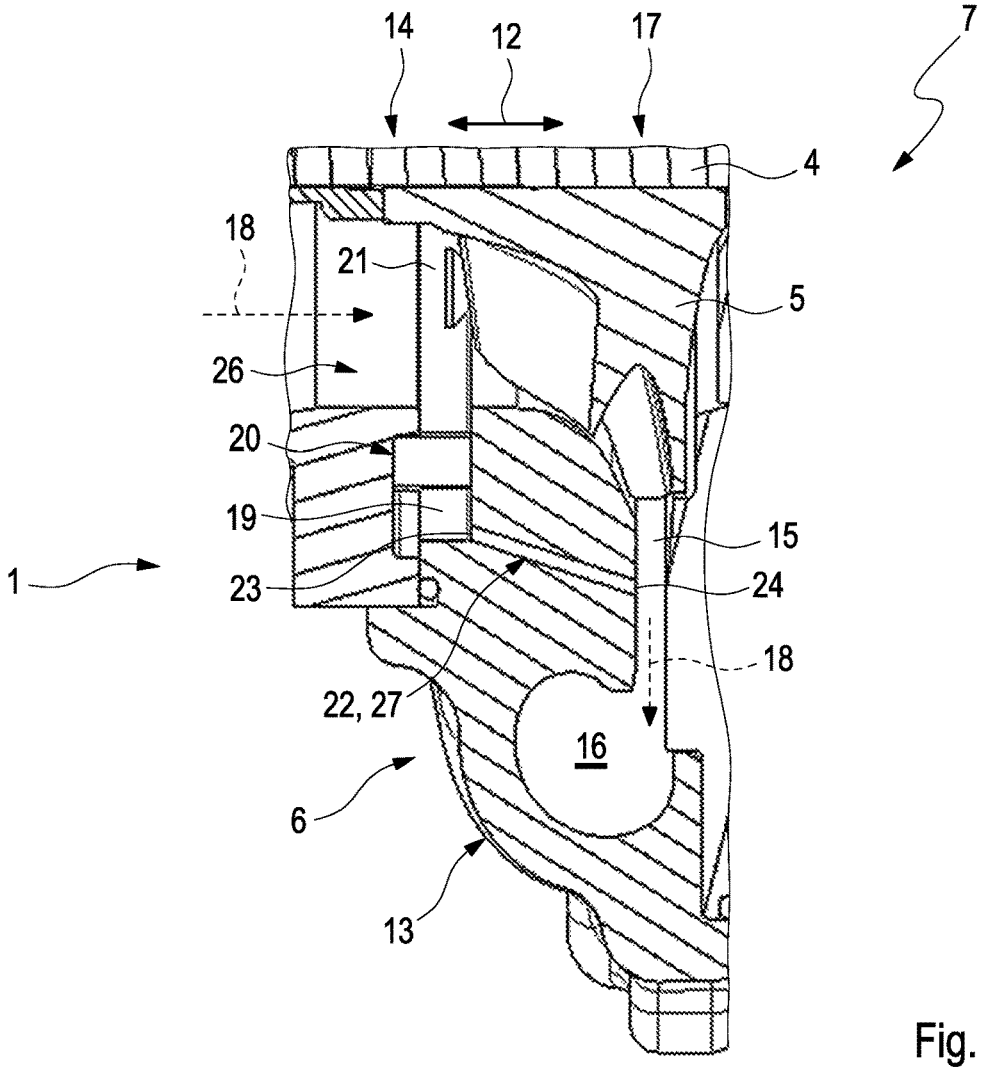
FIG. 2 shows a cross-section through a part of the radial compressor of the exhaust gas turbocharger.

FIG. 2 shows a section through the radial compressor 6 along the shaft 4, wherein merely one half of the radial compressor 6 is shown, which is the lower half in installed position. The shaft extends along an axial direction 12, i.e. parallel to the axis of rotation of shaft 4, and is rotatably arranged, in particular mounted, in a compressor housing 13 of the radial compressor 6. A flow channel 26 delimiting a flow path 18 of the air in the radial compressor 6 is formed inside the compressor housing 13. The flow channel 26 comprises a suction section 14, via which the compressor wheel 5, in operation, sucks in air axially and which in the example shown, extends in axial direction. Due to the rotation of the compressor wheel 5 the air is accelerated in radial direction and reaches via a diffuser 15 extending transversely to the axial direction 12, i.e. radially, a spiral channel 16 extending in circumferential direction, which are both constituents of the flow channel 26 and through which the flow channel 18 leads. The compressed air can be passed through the spiral channel 16 and fed in particular to the combustion engine 8. The spiral channel 16 and the diffuser 15 are formed in a circumferential section 17 of the compressor housing 13. In the suction section 14 a cavity 19 of a device 20 is formed. The device 20 serves the purpose of influencing the characteristic field of the radial compressor 6, in particular stabilising and/or changing it. With the example shown in FIG. 1, changing the characteristic field is effected with the aid of the device 20. To this end the device 20, in the example shown, comprises a hinted at, adjustable element 21, which is received in the cavity 19 and which, by means of an adjustment, changes the flow cross-section in the flow channel 26, in particular in the suction section 14, and thus the surface of the compressor wheel 5, which is exposed to the flow. The cavity 19 is fluidically connected to the flow path 18 or connectable in operation by adjusting the element 21. Liquid, in particular condensate generated in operation can collect in the cavity 19. Also foreign particles originating for example from the recycled exhaust gas can get into the cavity 19. In order to discharge this liquid, in particular condensate and/or the foreign particles, from the cavity 19, the radial compressor 6 comprises a discharge channel 22, which fluidically connects the cavity 19 to the spiral channel 16. The discharge channel 22 extends from an inlet mouth point 23 to an outlet mouth point 24. The inlet mouth point 23 is arranged on the cavity 19 such that the discharge channel 22 is directly fluidically connected to the cavity 19 via the inlet mouth point 23. The inlet mouth point 23 is arranged at an end of the cavity 19 facing away from the shaft 4. This end, in the installed position of the radial compressor 6, corresponds to the lower end of the cavity 19 viewed in vertical direction. In the example shown the outlet mouth point 24 is arranged on the diffuser 15, such that the discharge channel 22 extends as far as the diffuser 15 and is thus fluidically connected to the spiral channel 16. Due to the fluidic connection of the discharge channel 22 with the diffuser 15 the cavity 19 is exhausted when the radial compressor 6 is operating, so that liquid in the cavity 19 and/or foreign particles in the receiving chamber 19 are exhausted. The inlet mouth point 23 and the outlet mouth point 24 are radially and axially spaced apart from one another, such that the discharge channel 22 comprises a gradient, in particular a constant gradient. This means that the liquid can flow through the discharge channel 22 even outside the operation of the compressor wheel 5, and the liquid, in particular the condensate, in the cavity 19 and/or the discharge channel 22 can be prevented from freezing or at least freezing of the same can be reduced, when the outside temperatures are dropping. In this case the outlet mouth point 24 is arranged axially remote from the inlet mouth point 23 and the suction section 14, and radially remote from the compressor wheel 5/the shaft 4. Moreover the outlet mouth point 24 is arranged on the side of the inlet mouth point 23, which faces away from the compressor wheel 5/the shaft 4.

Figure 3:
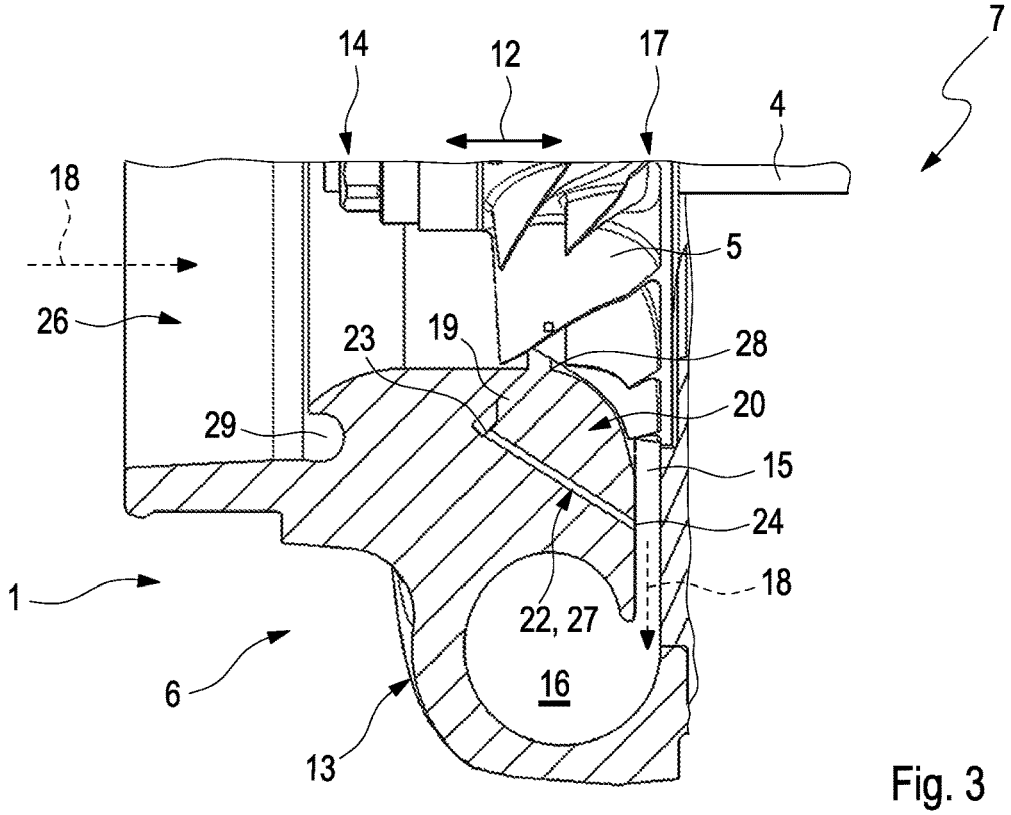
FIG. 3 shows a cross-section through a part of the radial compressor in another exemplary embodiment.

In FIG. 3 another exemplary embodiment of the radial compressor 6 is shown. This embodiment is different from the one shown in FIG. 2 in that the device 20 does not comprise such an element 21 received in the cavity 19. In this example the cavity 19 is fluidically connected to a suction section 14, for example in the area of a crescent-shaped indentation 29, and to a contour section 28 of the flow channel 26 following the shape of the compressor wheel 5, wherein the fluidic connection in the area of the indentation 29 in FIG. 3 is not visible because of the perspective. Thus the cavity 19 also establishes a fluidic connection between the suction section 14 and the contour section 28 and thus stabilises the characteristic field of the radial compressor 6. In difference to the example shown in FIG. 2 the cavity 19 therefore comprises two fluidic connections with the flow channel 26. In this case the inlet mouth point 23 is arranged at an end of the cavity 19 facing the shaft 4, so that liquid in the cavity 19, in particular condensate and/or foreign particles can flow away. Thus the discharge of the liquid and/or the foreign particles out of the cavity 19 is further simplified and/or improved.

Figure 4:
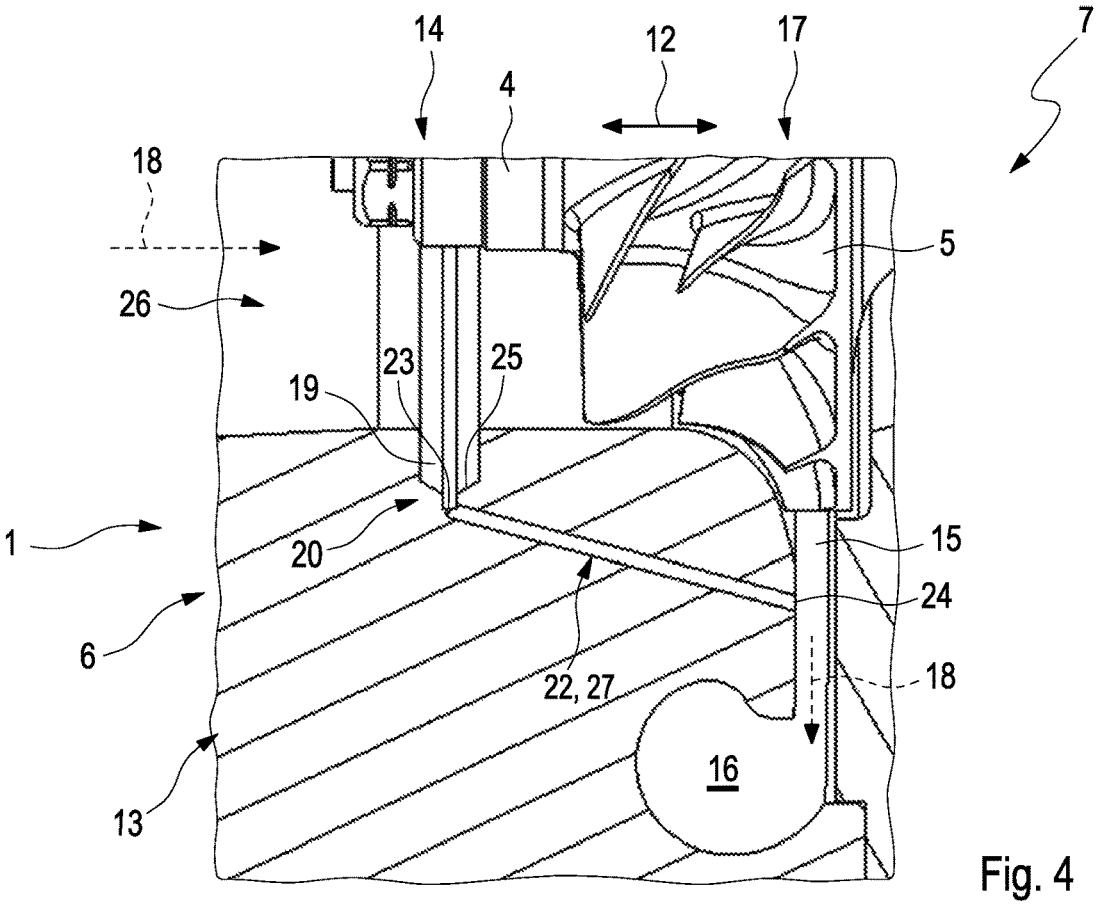
FIG. 4 shows a cross-section through a part of the radial compressor in a further exemplary embodiment.

FIG. 4 shows a further exemplary embodiment of the radial compressor 6. This embodiment can be realised alternatively or additionally to the variants depicted in FIGS. 2 and 3. In the example in FIG. 4 a catchment trough 25 extending in circumferential direction is formed on the side of the cavity facing away from the shaft 4. In the example shown the catchment trough 25 also comprises a shape tapering away from the shaft 4 in direction of the inlet mouth point 23 and is thus shaped like a funnel. Accordingly liquid, in particular condensate and/or foreign particles, collect in the cavity 19 in the catchment trough 25, even if the radial compressor 6 assumes an oblique position, which may for example occur when the combustion engine system 7, due to the arrangement in an oblique position relative to the horizontal, occupies an oblique position, in particular when an associated vehicle not shown is driving up a slope or down a slope.

In the examples shown the discharge channel 22 is formed as a bore 27 in the compressor housing 13.

The invention claimed is:

1. A radial compressor for an exhaust gas turbocharger, comprising:

a compressor housing, in which a flow channel is arranged, the flow channel delimiting a flow path of air through the radial compressor;

a compressor wheel arranged in the flow channel and non-rotatably coupled to a rotatably mounted shaft;

the flow channel having a suction section via which the compressor wheel sucks in air during operation;

the compressor housing having a circumferential section surrounding the compressor wheel in a circumferential direction, in which a spiral channel of the flow channel extending in the circumferential direction is arranged via which air compressed during operation via the compressor wheel flows out;

a device influencing a characteristic field of the radial compressor, the device including a cavity at least one of fluidically connected and fluidically connectable to the suction section; and a discharge channel arranged in the compressor housing feeding, via an inlet mouth point, into the cavity and extending to an outlet mouth point, the discharge channel fluidically connecting the cavity to the spiral channel.

2. The radial compressor according to claim 1, wherein the device further includes an element received in the cavity and configured to variably change a flow cross-section in the flow channel.

3. The radial compressor according to claim 1, wherein the outlet mouth point is disposed spaced apart axially and radially from the inlet mouth point relative to the shaft.

4. The radial compressor according to claim 1, wherein the discharge channel includes a gradient from the inlet mouth point to the outlet mouth point.

5. The radial compressor according to claim 4, wherein the gradient is constant.

6. The radial compressor according to claim 1, wherein the inlet mouth point is arranged at an end of the cavity facing away from the shaft.

7. The radial compressor according to claim 1, wherein the outlet mouth point is arranged on a side of the inlet mouth point opposite the shaft and at an axial distance from the inlet mouth point relative to the shaft.

8. The radial compressor according to claim 1, wherein the outlet mouth point is arranged on the spiral channel such that the discharge channel extends to the spiral channel.

9. The radial compressor according to claim 1, wherein the flow channel further includes a diffuser arranged between the compressor wheel and the spiral channel, wherein the discharge channel fluidically connects the cavity, via the diffuser, to the spiral channel.

10. The radial compressor according to claim 9, wherein the outlet mouth point is arranged on the diffuser such that the discharge channel extends to the diffuser.

11. The radial compressor according to claim 1, wherein the cavity includes a catchment trough on a side facing radially away from shaft into which the discharge channel feeds via the inlet mouth point.

12. The radial compressor according to claim 11, wherein the catchment trough tapers radially inward in a direction toward the inlet mouth point in a funnel-like manner.

13. The radial compressor according to claim 11, wherein the catchment trough extends in the circumferential direction.

14. The radial compressor according to claim 1, wherein the discharge channel is structured as a bore in the compressor housing.

15. An exhaust gas turbocharger comprising a turbine including a turbine wheel driven by exhaust gas during operation, and a radial compressor, the radial compressor including:

a compressor housing in which a flow channel is arranged, the flow channel delimiting a flow path of air through the radial compressor;

a compressor wheel arranged in the flow channel and non-rotatably coupled to a rotatably mounted shaft;

the flow channel having a suction section via which the compressor wheel sucks in air during operation;

the compressor housing having a circumferential section surrounding the compressor wheel in a circumferential direction, in which a spiral channel of the flow channel extending in the circumferential direction is arranged via which air compressed during operation via the compressor wheel flows out;

a device influencing a characteristic field of the radial compressor, the device including a cavity at least one of fluidically connected and fluidically connectable to the suction section; and a discharge channel arranged in the compressor housing feeding, via an inlet mouth point, into the cavity and extending to an outlet mouth point, the discharge channel fluidically connecting the cavity to the spiral channel;

wherein the shaft is drivingly connected to the turbine wheel.

16. The radial compressor according to claim 1, wherein:

at least a portion of the suction section extends axially relative to the shaft; and the cavity circumferentially surrounds the suction section relative to the shaft.

17. The radial compressor according to claim 1, wherein the suction section is arranged upstream of the compressor wheel and axially adjoins the compressor wheel.

18. The radial compressor according to claim 1, wherein the device further includes an element adjustably arranged within the cavity, and wherein an adjustment of the element alters a flow cross-section of the suction section.

19. The radial compressor according to claim 7, wherein the discharge channel defines a gradient from the cavity to the outlet mouth point such that an accumulation of at least one of a liquid and a plurality of foreign particles within the cavity is dischargeable therefrom via the discharge channel when there is not a pressure difference between the suction area and the spiral channel.

20. A radial compressor for an exhaust gas turbocharger, comprising:

a compressor housing in which a flow channel is arranged, the flow channel delimiting a flow path through which air is flowable;

a compressor wheel arranged in the flow channel and non-rotatably coupled to a rotatably mounted shaft;

the flow channel having a suction section through which air is drawable via the compressor wheel, at least portions of the suction section extending axially relative to the shaft;

the compressor housing having a circumferential section circumferentially surrounding the compressor wheel;

the flow channel including a spiral channel disposed within the circumferential section and extending in a circumferential direction therein through which air compressed via the compressor wheel is flowable;

the flow channel including a diffuser extending substantially radially to the shaft and fluidically connecting the compressor wheel and the spiral channel;

a device configured to influence a characteristic field, the device including a cavity circumferentially surrounding and fluidically connected to the suction section; and a discharge channel arranged in the compressor housing extending from an inlet mouth point in the cavity to an outlet mouth point, the discharge channel fluidically connecting the cavity and the spiral channel.

* * * * *